United States Patent [19]

Franklin

[11] Patent Number: 4,707,940

[45] Date of Patent: Nov. 24, 1987

[54] AMPHITHEATER DISPLAY WITH END CAPS

[75] Inventor: Robert P. Franklin, Lake Hopatcong, N.J.

[73] Assignee: Trans-World Manufacturing Corporation, East Rutherford, N.J.

[21] Appl. No.: 821,170

[22] Filed: Jan. 21, 1986

[51] Int. Cl.[4] ..... G09F 7/00

[52] U.S. Cl. ..... 40/605; 211/199; 52/38

[58] Field of Search ..... 40/605, 539, 611; 248/174; 52/38; 211/189, 198, 199

[56] References Cited

U.S. PATENT DOCUMENTS 3,449,848 6/1969 Howell ..... 40/605

4,428,136 1/1984 Franklin ..... 40/605

*Primary Examiner*—Carl D. Friedman

*Assistant Examiner*—Naoka N. Slack

*Attorney, Agent, or Firm*—Ostrolenk, Faber, Gerb & Soffen

[57] ABSTRACT

A kit for forming a variable sized bay-shaped display comprises rear well sections coupled together, bay dividers formed of hinged panels, and end caps covering the hinge of the divider to which it is attached.

6 Claims, 15 Drawing Figures

FIG. 8.
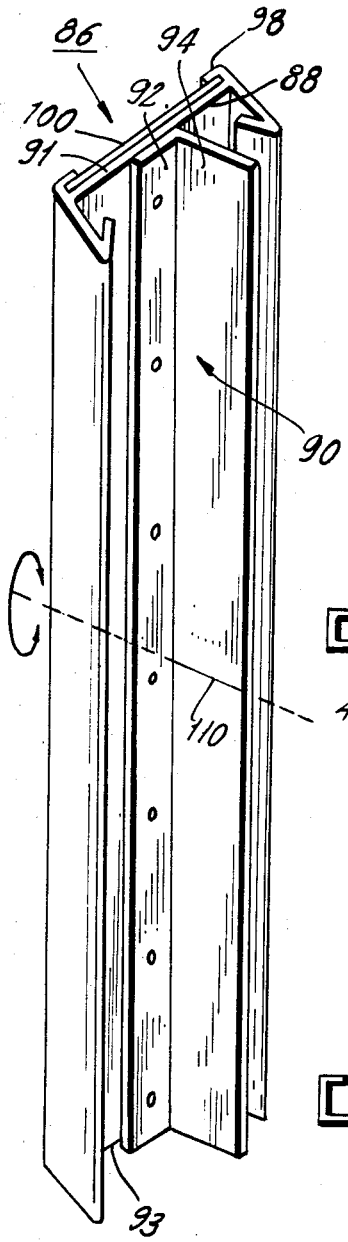
FIG. 7.
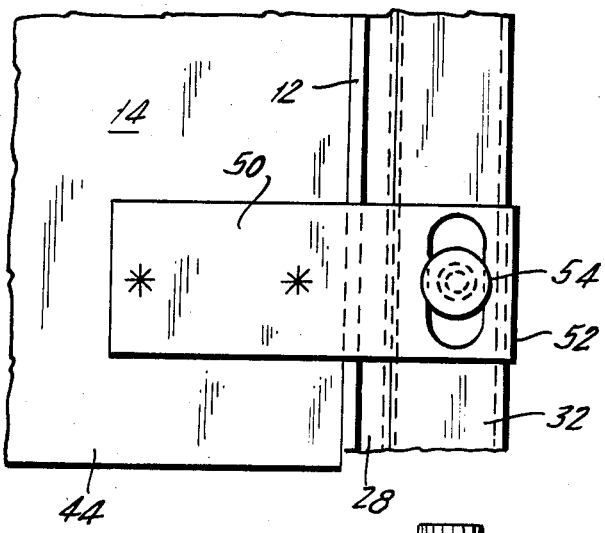
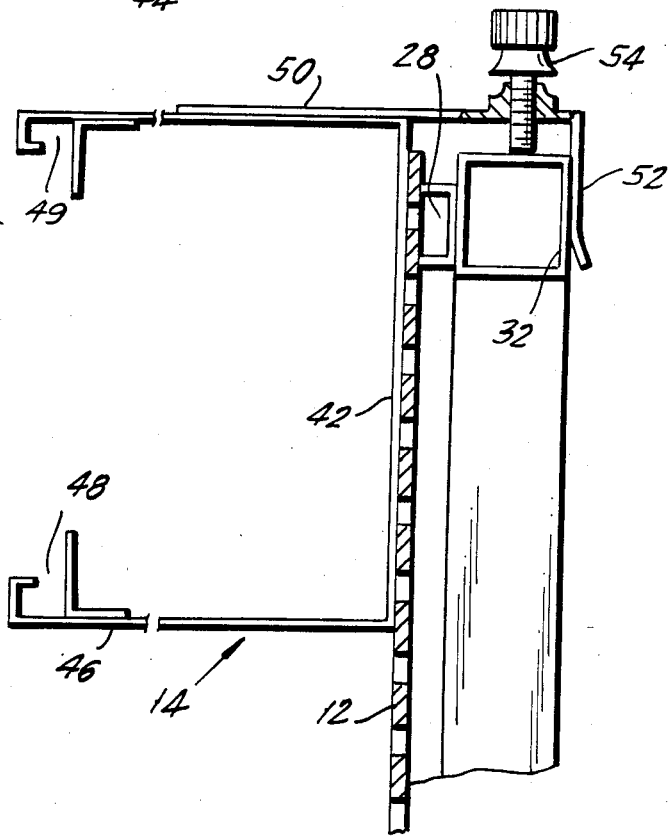
FIG. 6.

AMPHITHEATER DISPLAY WITH END CAPS

BACKGROUND OF THE INVENTION

The present invention relates to a display structure for displaying goods in retail outlets, and more particularly to a display showcase for displaying therein different types of small merchandise arranged in an appealing and non-cluttered manner in bays which are created in the display unit through specially designed divider panels. The display unit is assembled of modular sections so that variably sized display units can be assembled. Additionally, display unit dividers can be positioned anywhere along the main display wall and variously sized bays may be created upon initial assembly of the unit or at a later date to accommodate changing requirements.

Display devices of the type referred to above are described, for example, in U.S. Pat. No. 4,428,136 and in copending application Ser. No. 533,213, filed Sept. 19, 1983. As shown in these patents, a display unit of this type consists of a peg board main display wall from which merchandise is suspended from support rods or hooks which are inserted into the peg board. To create a panoramic and integrated look, the wall is divided into individual display bays which are created by display dividers which rest on a base which projects from the bottom of the rear display wall.

Each display divider is constructed of two vertically disposed panels which are hingedly attached to one another. The two panels which constitute one divider are swung away from each other and are separately attached to the rear wall so that together with the rear walls the structures define a triangle. When so assembled, each bay provides three display walls which are constructed of two side panels with a rear wall section which is interposed therebetween. Because the side panels are angularly disposed with respect to the rear wall, each bay provides a panoramic display surface on which the merchandise can be arranged and displayed in a very orderly and appealing manner.

When viewed from a distance, the various bays appear as a continuous cohesive and integrated showcase, and a purchaser is capable of, at once, focusing on a particular class of goods which he or she is desirous of examining. The integrated and cohesive look of the display unit is further enhanced by an upper principal header which extends along the upper periphery of the rear wall and which is adapted to support placards and other information bearing devices. Auxiliary header pieces are provided on each panel of a display divider and are designed to similarly support placards or similar devices. The auxiliary header devices are constructed to curve into and mesh with the principal header on the rear wall to thus complete the integrated and essentially unitary appearance of the display unit.

However, while the above noted multi-bay display has achieved its stated goal of providing an integrated appealing and adjustable display unit, several problems and disadvantages remain. For example, in assembling the display unit it is preferable to assemble the unit from a plurality of sub units each 3–5 feet wide. Each subunit includes a base, a rear wall member and a header connected to the rear wall member. Since it is difficult to insure that the height of each rear wall of each subunit is exactly equal, the headers located on the top of adjacent rear walls will not necessarily be the same height.

This ruins the continuity of the display and prevents it from appearing to be a single continuous unit.

Furthermore, with the previous designs, a support structure mounted on the backface of the rear wall interferes with the insertion of hangers or hooks into the rear wall peg board which results in a reduction in the useful display area and which further acts to detract from the ability to pleasingly arrange goods which is a primary objective for the display unit.

Finally, the otherwise pleasing and integrated appearance of the display unit is marred by the exposed edges of the display unit dividers along their hingedly attached edges which closely face prospective purchasers.

SUMMARY OF THE INVENTION

Accordingly, it is an object of the present invention to disclose a variably sized bay-shaped display unit assembly in which the principal header in which placards and other information devices are supported, can be adjustably mounted against the rear wall of the display unit to insure that the principal header can be horizontally leveled to improve the readability of the information bearing devices and to account for mismatches in the construction of the rear wall of the display unit.

It is a further object of the present invention to disclose an adjustable display unit which is modularly constructed to ease the shipment and field assembly of the display device, to provide a variably sized display device, and to provide a display unit in which the subdivision of the display unit into bays can be individually tailored for each application.

It is still a further object of the present invention to provide a display unit in which interconnecting and reinforced hardware does not interfere with or reduce the useful display area on the rear wall of the display.

Still a further object of the invention is the disclosure of a display device in which the hingedly adjoined edges of display dividers are concealed by end caps which can be ornamental and/or informative of the goods stored in respective bay areas.

The foregoing and other objects are achieved through the variably sized bay-shaped display unit assembly described herein. The display unit assembly includes a plurality of rear wall sections which can be assembled at the customer's site to form a continuous rear wall from which small merchandise can be suspended by means of hooks which fit into the rear wall. Each rear wall section is reinforced on its backside by a rectangularly shpaed frame which extends along its peripheral backside edges. To ensure that the frame does not interfere with the insertion of hooks into the rear wall, an inner section of the frame is constructed as an inverted U-shaped channel which is opened toward the backside of the rear wall to ensure that hooks or other support pegs can be inserted along all available surfaces of the rear wall. Additionally, through the frame, the individualized rear wall sections can be connected to each other through hooks and complementary latches which are provided for fastening the sections to each other to form the continuous, variably sized, display wall.

A principal header extends along the upper periphery of the front face of the rear wall. Its function is to support placards or other information bearing devices therein. At least two rearwardly extending brackets, located at either end of the generally elongated principal header, are provided for attaching the principal header to the rear wall. The principal header is suspended below the bracket which, as previously stated, extend rearwardly and is bent down to reach above and around the rear mounted frame of the rear wall. The brackets are provided with bolts which are located and designed to engage the frame of the rear wall. Through the bolts, the height of the brackets, and hence the header, above the upper periphery of the rear wall is adjustable. Consequently, the bolt to rear wall frame coupling at either end of the principal header is coordinated to ensure that the principal header is horizontally level as previously described. In preferred embodiments it is shown that additional brackets may be provided in the areas where rear wall sections meet in order to improve and enhance the structural rigidity of the rear wall.

The display unit is divided into bays through the display dividers. Each display divider includes a first and second panel which are hingedly connected to one another at one of their respective vertical edges. The effective width of each panel may be extended through the use of an extension member. The first and second panels are spread out about their common hinge and their free vertical edges are brought against and fixed to the rear wall. With the present configuration, a top view of the rear wall and of the two panels which are mounted against it define a triangle which is right angled for the two display dividers located at either end of the display unit and which defines an isosceles triangle for the other intemediate display dividers. To cover up the hinges which interconnect every display divider panel pair, the invention provides for an end cap which extends vertically along the hinged ends of the first and second panels. The face of the end cap can have an ornamental finish and/or it may provide a channel for supporting information bearing materials. The ends caps are removably attached to each display divider, and the special attachment hardware is designed such that the same parts may be useful for a right hand, a left hand or an intermediate display divider. Additionally, the attachment hardware is configured to ensure that the front face of the end cap remains substantially parallel to the rear wall of the display.

Other preferred embodiments of the invention disclosed that the display unit is provided with subsidiary headers which are disposed along the upper periphery of the display headers and are designed to blend in and mesh with the principal header in order to provide a continuous integrated appearance for the display unit. Additionally, various trim and finish parts are provided to cover up and conceal the various interconnecting, attachment and mating hardware.

Other features and advantages of the invention will be apparent from the following description of preferred embodiments of the invention considered with reference to the accompanying drawings.

BRIEF DESCRIPTION OF THE DRAWINGS

FIG. 6 is a side view of the principal header which shows the manner of attaching the principal header to the rear wall.

FIG. 7 is a top view of the principal header bracket of FIG. 6.

FIG. 8 is a perspective view showing an end cap.

DETAILED DESCRIPTION OF THE INVENTION

The display device in accordance with the present invention includes three main structural sections. These are: the rear display wall, the principal header, and the display dividers. They will be described in turn after a brief introduction which refers to FIG. 1.

Figure 1:
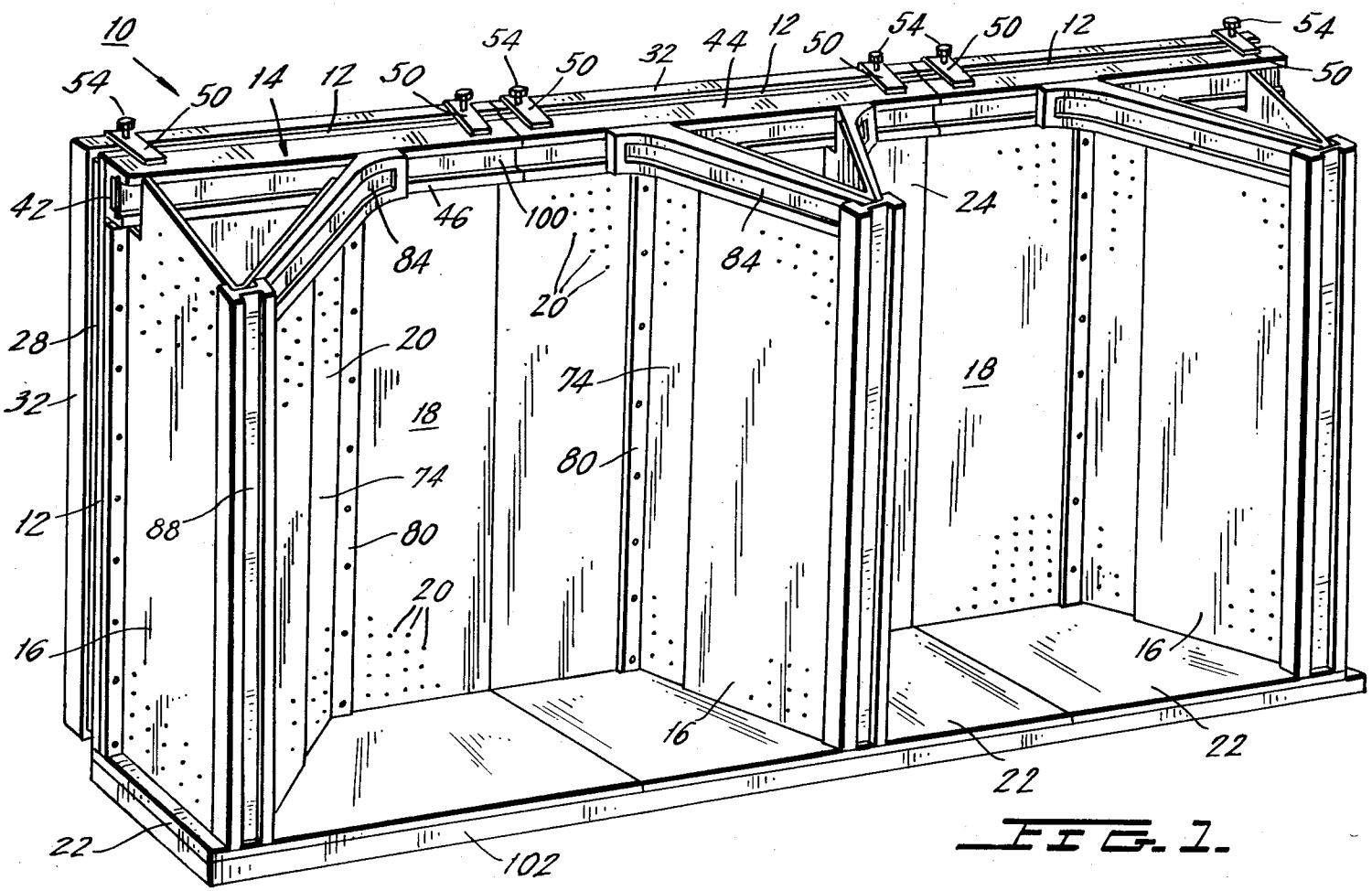
FIG. 1 is a perspective view of a display unit constructed in accordance with the principles of the present invention.

In FIG. 1 the display unit, designated generally as 10, includes a rear wall 12, a principal header 14 which extends along the upper periphery of the rear wall 12, and display dividers 16 which create bays 18, in which merchandise is stored. The rear wall 12 and dividers 16 are constructed preferably of peg board. The preforations 20 in the peg board provide an anchoring point for hooks or hangers 30 from which small merchandise may be suspended as previously described. The display dividers 16 are generally angularly disposed with respect to the rear wall 12, so that each bay provides a panoramic display surface on which the merchandise can be displayed. The display dividers are anchored to the rear wall 12 which has a base 22 extending forwardly therefrom.

The rear wall 12 of the display unit 10 is preferably comprised of a plurality of rear wall sections 24 (see FIG. 4) which are interconnected to from one continuous wall. Each rear wall section 24 is preferably six feet high and two to five feet wide. A separate base section 22 is coupled to each rear wall section 24 by appropriate means (not shown).

Figure 4:
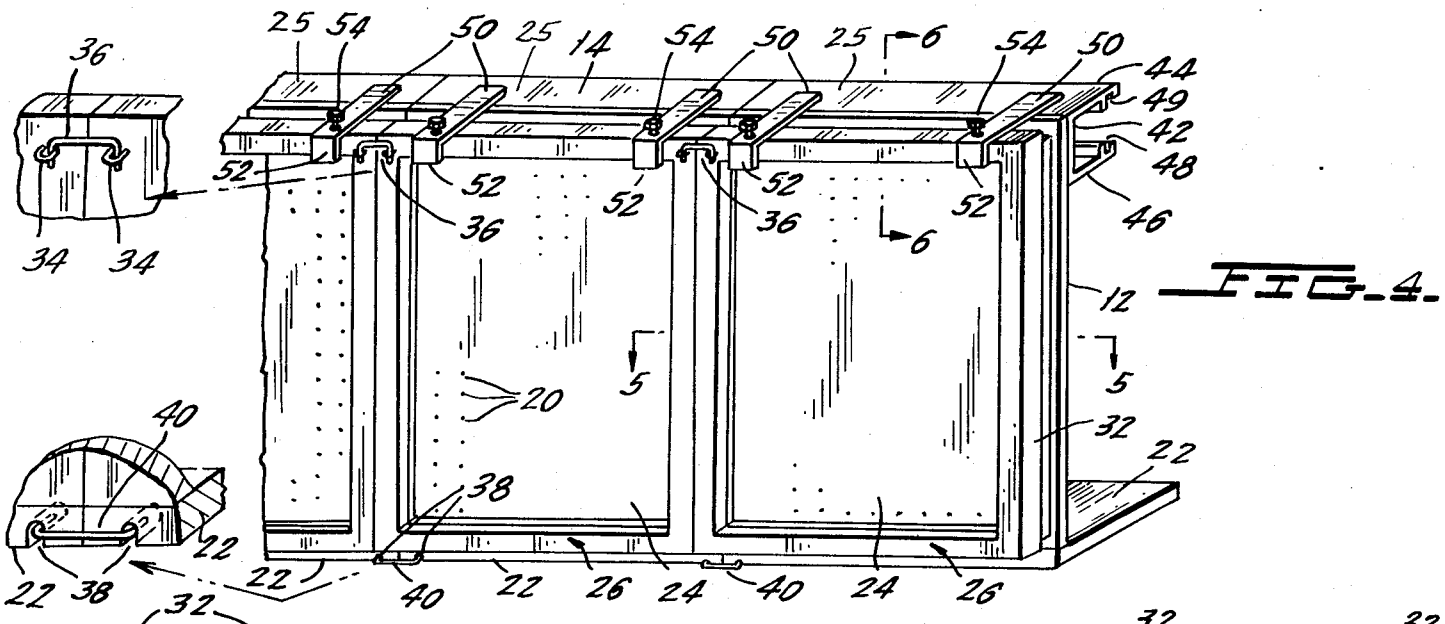
FIG. 4 is a perspective view showing the individual support reinforcement frames around each rear wall section, the manner by which the principal header is attached to the rear wall, and the hardware for interconnecting the rear wall sections to form the continuous rear wall.
Figure 5:
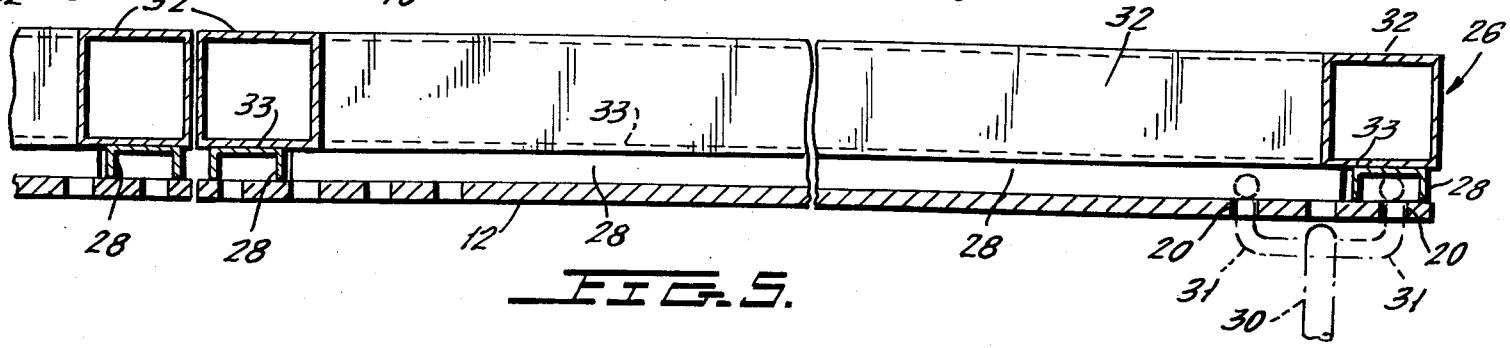
FIG. 5 is a sectional view of the U-shaped support channel forming part of the reinforcement frames and taken along lines 5—5.

As best shown in FIGS. 4 and 5, along the peripheral rear edges of each rear wall section 24, rectangular supporting structure 26 (which forms part of the rear wall 12) is provided for reinforcing each rear wall section 24 and for providing a structure by which each section 24 can be interconnected with other sections and with other elements of the display unit. The supporting structure 26 consists of a U-shaped channel 28 surrounding the rear wall section and a larger tubular support channel 32 located on the channel 28. The tubular channel 32 is the main weight bearing element of display 10 and also serves as an anchor point to which the principal header 14 may be attached. If the channel 32 were connected directly to the rear wall section 24, the front wall 33 (FIG. 5) of the channel 32 would lie adjacent to two vertical and two horizontal rows of holes 20 and would prevent prongs 31 of hooks 30 from extending through the rear wall section 24 at that location. This significantly limits the possible hook arrangement (and therefore the arrangements of the merchandise being displayed) which are available to the retailer utilizing the display 10.

In order to overcome this problem, the present invention provides a U-shaped channel 28 which interfaces the support channel 32 and the rear wall section 24. Alternatively, the support channel 32 can itself be formed as a U-shaped channel or the U-shaped channel 28 can be formed integrally with the support channel 32. The location of the channels 28 are selected to ensure that each vertical and horizontal section of the channel aligns with a respective vertical or horizontal row of holes 20 in the peg board to provide a clearance to insure that the prong 31 of a hook 30 (FIG. 5) may be inserted into the rear wall section peg board without interference from the reinforcement structure. This provides the retailer with significantly improved flexibility in the manner in which he can arrange his products for display and also makes the appearance of the displayed goods more attractive.

Figure 9:
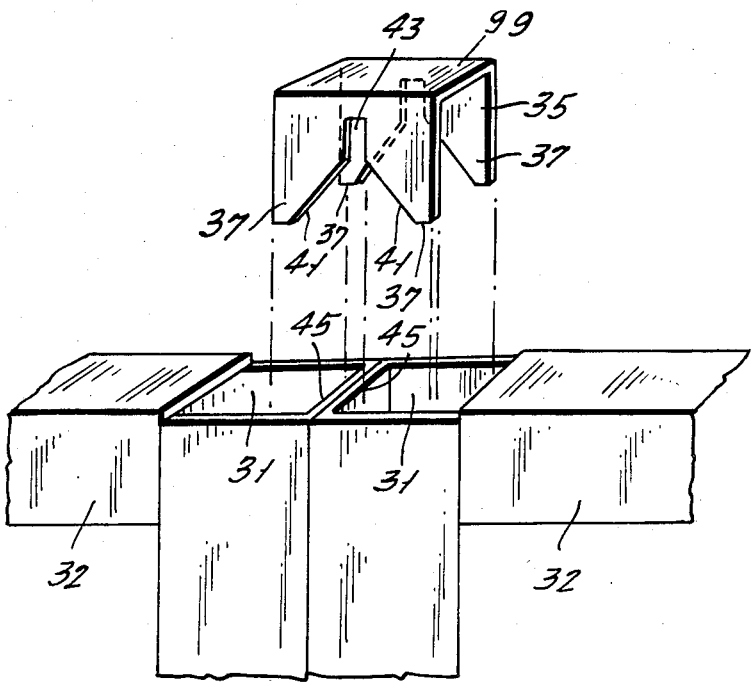
FIG. 9 is a large exploded view of the upper left and right hand corners of the support channels of FIG. 4 showing an alternative manner in which they may be joined together.

In the upper corners of each rear wall section, there is provided a hook 34 which protrudes from the tubular support channel 32 and make it possible to interconnect adjacent rear wall sections 24. As best shown in the blown-up section of FIG. 4, respective prongs of a U-shaped latch 36 may be inserted into two adjacent hooks 34 to secure the top edges of adjacent sections 24 to one another. In an alternate embodiment, illustrated in FIG. 9, openings 33 are formed in the upper left and upper right hand corner of the support channel 32 and a joint or clete 35 is utilized to couple to tops of adjacent support channels 32 together. The clete 35 includes two pairs of prongs 37 which depend downwardly from opposite sides of a cross piece 99. The prongs 37 are camphored at 41 and extend to a pinching slot 43.

The depth of the cross piece 99 is less than or equal to the depth of the notches 31′ in the support channels 32. The width of the pinching slot 43 is chosen to be slightly greater than the combined widths of the walls 45 of the support channel 32 so as to pinch these walls firmly together and thereby firmly hold adjacent rear wall sections 24 together.

Figure 10:
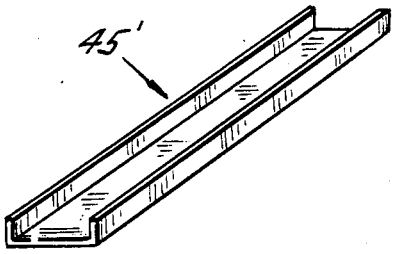
FIG. 10 is a perspective view of a U-shaped channel which may be used to couple the lower portions of adjacent bases together.

In the lower rear corners of each base 22 (which is attached to a respective rear wall section 24), a notch 38, which is preferably $\frac{3}{8}''$ deep and $\frac{1}{8}''$ wide, is provided. Respective prongs of second U-shaped latch 40 are inserted into adjacent notches 38 to ensure that the bottom edge of rear wall sections 24 are secured to one another. In an alternative embodiment, the notches 38 extend substantially the entire depth of the bases 22 (i.e. from the front of the base to the rear of the base) and the U-shaped latch 40 is replaced by a U-shaped channel 45′ as shown in FIG. 10.

Figure 12:
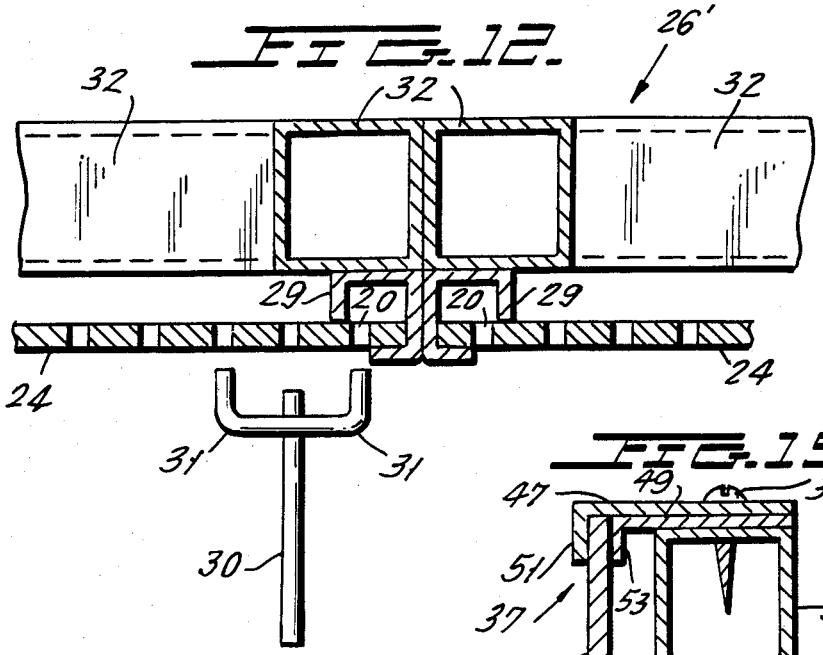
FIG. 12 is a sectional view of a C-shaped support channel forming part of an alternative embodiment of the reinforcement frame of the present invention.
Figure 15:
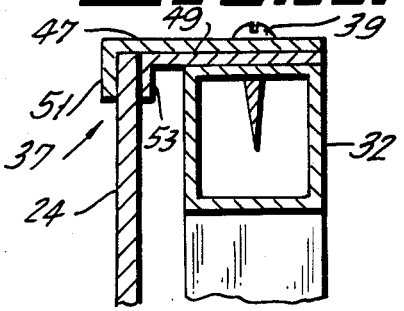
FIG. 15 is a sectional view of a top portion of the modified reinforcement frame taken along lines 15—15 of FIG. 13.
Figure 13:
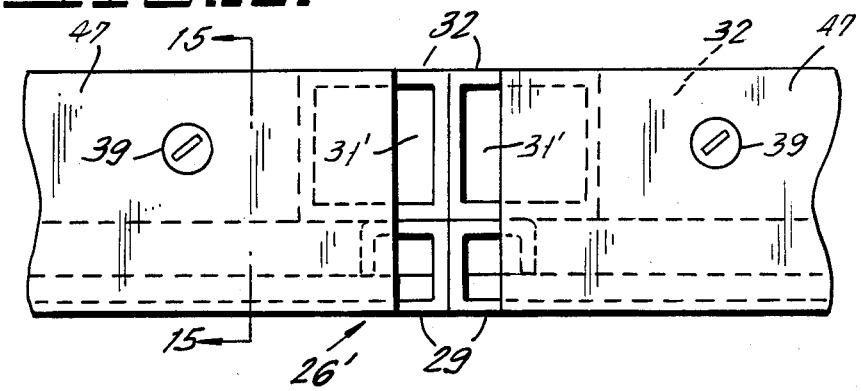
FIG. 13 is a partial top view of the modified reinforcement frame of FIG. 12.

A modification of the rectangular supporting structure 26 is illustrated in FIGS. 12, 13 and 15. The primary difference between the modified supporting structure 26′ of this embodiment and that of the embodiment of FIGS. 4 and 5 is that the U-shaped channel 28 of the first embodiment is replaced by a roll formed C-shaped channel 29. As with the U-shaped channel 28, the C-shaped channel 29 serves to offset the rear wall sections 24 from the tubular support channel 32 so as to enable the prongs 31 of the hook 30 to be inserted into the edge most holes 20 in the rear wall sections 24. The C-shaped channel 29 (which is preferably welded to the tubular support channel 32) also serves as a frame which holds the rear wall sections 24 in place. This avoids the need for pop rivets or similar connecting structure to connect the rear wall sections 24 to the supporting structure 26 of the embodiments of FIGS. 4 and 5. The C-shaped channels surround at least the left and right hand edges of the rear wall sections 24 to the supporting structure 26 of the embodiment of FIGS. 4 and 5.

Figure 14:
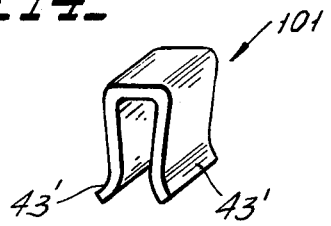
FIG. 14 is a perspective view of a clip used in connection with the modified reinforcement frame to connect adjacent frames together.

The C-shaped channels surround at least the left and right hand edges of the rear wall section 24. They may also surround the bottom most edge, if desired. During construction, the rear wall sections 24 are slided down between adjacent channels into the position illustrated in FIG. 4. They are then locked within the supporting structure by the use of an F-shaped top piece 47 which is preferably connected to the upper support channel 32 by screws 39 or similar means. As thus seen in FIG. 13, the top piece 37 preferably extends the entire depth of the support structure 26′ to create a clean look. The top piece 37 extends substantially the entire width of the support structure 26′ for the same reason. A small clearance is provided adjacent opposite ends of the supporting structure 26′ to leave exposed openings 31 in adjacent tubular support channels 32. The openings 31 receive respective prongs 43′ of a clip 101 (FIG. 14) used to tightly hold adjacent support channels 32 together.

As best shown in FIG. 15, the F-shaped top piece 37 is preferably formed of two L-shaped channels 47, 49 which are welded or otherwise coupled together. The spacing between perspective legs 51, 53 of the L-shaped channels 47, 49 is preferably slightly greater than the depth of the rear wall section 24 so as to closely accommodate the same.

Next, the principal header 14 will be described and details of its connection to the rear wall will be provided with reference to FIGS. 4, 6 and 7. As previously stated, one function of the principal header 14 is to provide a support for information bearing devices such as placards and the like. However, the principal header 14 also serves for covering and concealing mismatched adjoining rear wall sections 24. In the presently preferred embodiment, principal header 14 is formed of a plurality of principal header sections 25 which correspond in length to the rear wall sections 24. Particularly, each header section 25 is of equal width and is connected to the top wall of the respective rear wall section 24. While the principal header 14 is preferably formed in sections, a single header may extend two or more rear wall sections 24, as desired. Hereinafter, the principal header sections 24 will be referred to generically as the principal header 14.

The principal header 14 comprises an open tubular elongated section defined by a rear section 42, an upper section 44 and a lower section 46 having respective channels 48 and 49 defined at the distal ends thereof which cooperate to support a placard or the like. A plurality of brackets 50 are coupled to the top section 44 and are used to attach the principal header 14 to the rear wall 12 of the display unit 10. Each bracket 50 is L-shaped and may be riveted, welded or otherwise secured to the upper section 44 of the principal header 14. The depending section 52 of the L-shaped bracket extends downwardly and wraps the tubular supporting channel 32 of the rear wall 12. A respective bolt 54 is threadably received in each bracket 50, and sits on the top surface of the tubular channel 32 of the supporting structure 26. The tubular channel defines a convenient support base for the bolts 54. Other support bases may, however, be used. By rotating the bolts 54 clockwise or counter-clockwise, it is possible to adjust the height of the principal header 14 relative to the top of the rear wall 12. Thereby it is possible to adjust the principal header 14 to ensure that it is horizontally level and to compensate for variations in the height of adjacent rear wall sections 24. In an alternative embodiment, the bolts 54 may be threadably received in the tubular channel 32 to reinforce the rear wall 12 which is comprised of the plurality of rear wall sections 24. The principal header 14 may include intermediate brackets 50 which are arranged in pairs and which can be used to attach adjoining rear wall sections 24.

While the foregoing structure of header 14 possesses many advantages, it is somewhat unsightly when viewed from the top. If the display is used at a location where the top view is visible, it is preferable to form the header 14 without the brackets 50 and to couple the rear section 42 of the header 18 directly to the rear wall section 24. This can be done by using screws, bolts, pop rivets or other suitable coupling means. It is desirable to form a key hole type opening in the rear section 42 through which bolts can be extended. By using a key hole shaped opening, it is possible to effectively adjust the height and angle of the header 14 by moving the header up or down relative to the bolts and then tightening the bolt when the header is in the desired position.

Now that the manner of assembling the rear wall 12 and the principal header 14 have been described, the structure of the display dividers 16 will be described with reference to FIGS. 1–3 and 8 of the drawings.

Figure 3:
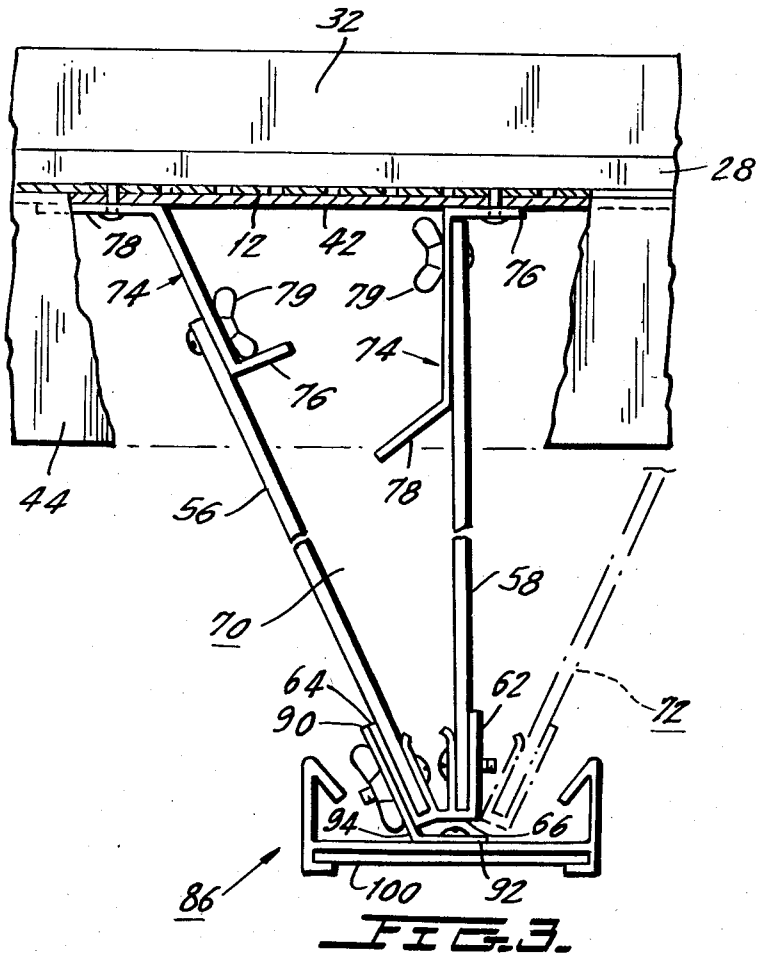
FIG. 3 is a top view of a right-hand divider of FIG. 1, and shows additionally (in bracketed lines) a construction for an intermediate display divider. A top view of the mounting means for the end caps is also shown.
Figure 2:
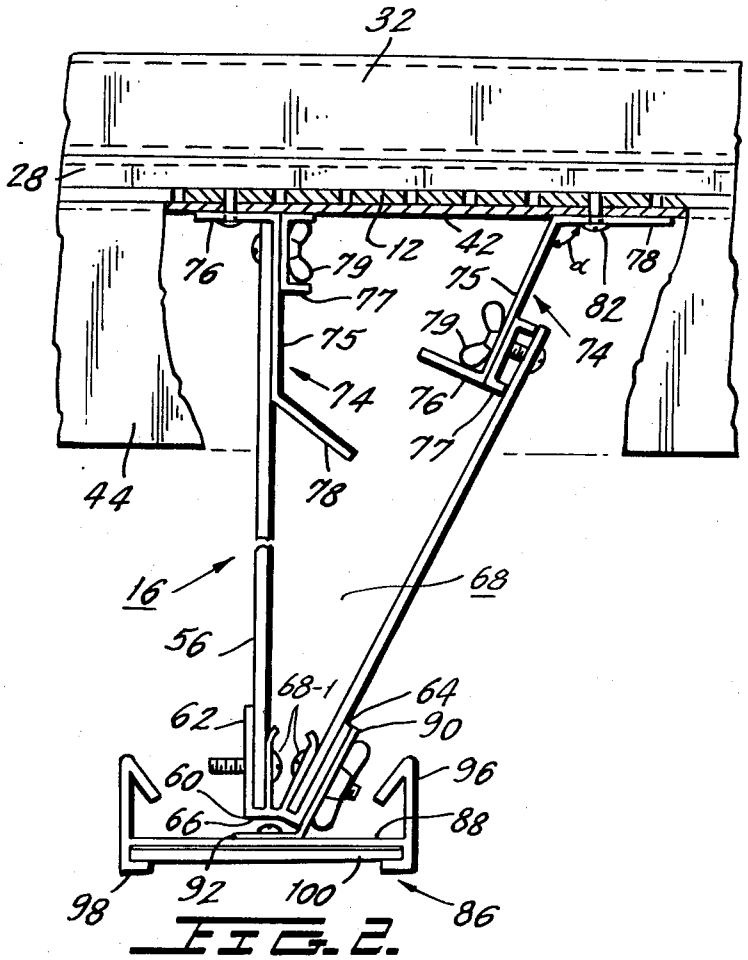
FIG. 2 is a top view of a left-hand divider of FIG. 1.

Each display divider 16 includes a left panel 56 and a right panel 58 which are hingedly connected to each other by a hinge 60. The hinge 60, shown in FIGS. 2, 3 and 8, is a plastic part which includes a left sleeve 62, a right sleeve 64 and a center region 66 which is flexible. The left sleeve and the right sleeve are designed to receive respective edges of the left panel 56 and the right panel 58. Bolts 68-1 may be added for securing of the hinges to the side panels 56, 58, however, other or similar methods are equally useful for this purpose.

Each display divider can now be configured as a left hand divider 68 (FIG. 2), a right hand divider 70 (shown in solid lines in FIG. 3), or a center divider 72 (shown in phantom in FIG. 3). This configuration is accomplished by adding to the free edge of each side panel an extension piece 74. The extension piece 74 is designed as a standard part which can be connected to the side panels in several modes in order to configure the display divider panels as necessary as described in detail in copending application Ser. No. 533,213. The extension piece 74, comprises a center section 75 of a height approximately equal to the height of each side panel 56, 58. From the center section 75 emerges a right angle section 76, and an oblique angle section 78. A plurality of holes may be provided in the free edges of side panels 56, 58 and in the extension member. By aligning the respective holes in the extension member and in the free edges of the side panel, the extension member can be connected to the side panel in one of several orientations as shown in FIGS. 2, 3 and 8. Each side panel can be configured with the extension piece 74 to engage the rear wall at either a right angle or at an oblique angle.

In the embodiment of FIG. 3, the extension sections 74 are connected flush with the side panels 58, 60 by respective wing nuts 79. In the embodiment illustrated in FIG. 2, U-shaped channels 77 (which extend the entire height of extension members 74) serve substantially the same purpose as channels 28 of supporting structure 26. Particularly, these channels are aligned with a row of holes in the peg board forming the side panels when the extension section 74 is connected to the side panel to form the angle $\alpha$ as shown in FIG. 2. The width of the channel 77 is preferably sufficiently wide to permit the wing nut 79 to be recessed therein, as shown in the right angle connnection of FIG. 2.

To form a left hand display divider, the left side panel is assembled with an extension as shown in FIG. 2 to engage the rear wall 12 perpendicularly. At the same time, the right panel 58, is fitted with the extension so that the panel rests obliquely against the rear wall 12. To assemble a right handed display divider, the side panels and the extensions are assembled as shown in FIGS. 3 and 8. The dashed line section of FIG. 3 shows a third configuration for the display dividers, which is useful for an intermediate display divider, as shown in FIG. 1. For an intermediate display, both side panels of the divider are oriented obliquely with respect to the rear panel and form an isosceles triangle with the rear wall serving as its base. In all three cases, at least one of the side panels 56, 58 will form a predetermined angle $\alpha$ (for example 135°) with the rear wall 12, the specific angle will be determined by the angle 2 between the center section 75 and the oblique section 78 of the extension piece 74.

An assembled display divider consisting of the two side panels which are hingedly attached to each other and to which a right sided and a left sided extension piece have been added, are positioned on the base 22 of the display unit and are attached to its rear wall 12 with bolts which are fitted in a series of holes in the respective right angle section or oblique section of the extension piece 74. A typical fully assembled display unit, will include a right hand divider, a left hand divider and one or more intermediate dividers as necessary for creating a sufficient number of bays.

The assembly of the display unit is completed through the addition of various trim and finish parts. For example, decorative strips (not shown) may be utilized to cover up the bolts or rivets 82 which are used for connecting each side panel of the display divider to the rear wall. Similarly, as described in U.S. Pat. No. 4,428,136, subsidiary headers 84 may be fixed to the upper periphery of each side panel to provide the display unit with its integrated look. The subsidiary headers are designed to mate with and curve into the principal header in such a fashion that a principal header seems to comprise a single continuous header.

In addition to the various trim and finishing parts described above, the improved display unit includes end caps 86 for covering and concealing the hinges 60 of the side panels. Each end cap 86 is a longitudinally elongated trim piece (see FIG. 8) preferably having a length equal to the height of side panels 56, 58. The end cap 86 preferably includes a flat strip 88 which is positioned in front of the hinge 60 by means of an angled bracket 90. The bracket 90 consists of a flat section 92 and an oblique section 94 which forms an angle with the flat section 92 which is equal to the angle $\alpha$ formed by the center section 75 and the oblique angle section 78 of the extension 74 so as to ensure that the flat strip 88 of end cap 86 is parallel to the rear wall 12. While a single bracket 90 which extends the entire height of the end cap 86 is shown, one or more shorter brackets can be used to achieve the same result. Additionally, while a generally planar end cap is shown, other shapes, such as an end cap having a semi-circular cross section could be used. Whatever the specific shape, the end cap should preferably be symmetrical about its longitudinal axis so that it will have the same appearance whether it is inverted with the end 91 up and the end 93 down or vice versa.

The flat strip 88 of the end cap 86 is connected to the flat section 92 of the bracket 90 by means of bolts or the like and the oblique section 94 of the bracket 90 is similarly connected to an obliquely oriented side panel (56 or 58) of the display divider. As a result of this structure, the same end cap 86 can be used as an end cap for the left hand divider 68, or the right hand divider 70 on the center divider 72 by merely rotating end cap 88 about the axis 110 so as to orient end cap 88 with the oblique section 94 angling to the right or left as shown in FIGS. 2 and 3. This significantly reduces manufacturing costs since a single type of end cap can be manufactured and warehoused for both purposes. Additionally, this provides the retailer with greater flexibility in the design of the display unit since each divider and end cap pair he has ordered can be used as a left hand, a right hand or a center divider.

The flat strip 88 of the end cap is bound on either end by respective transversely oriented and rearwardly extending peripheral skirts 96. The inwardly extending skirts 96 enclose and conceal the hinges 60 and the associated attachment hardware to prevent these parts from being seen from the side. The side skirts 96 also include a front extension 98 with a right angle protrusion for defining the channel 100 in front of the flat strip 88. Into the channel 100, there may be fitted an ornamental reflective mylar strip to cover the flat strip or other ornamental material.

Figure 11:
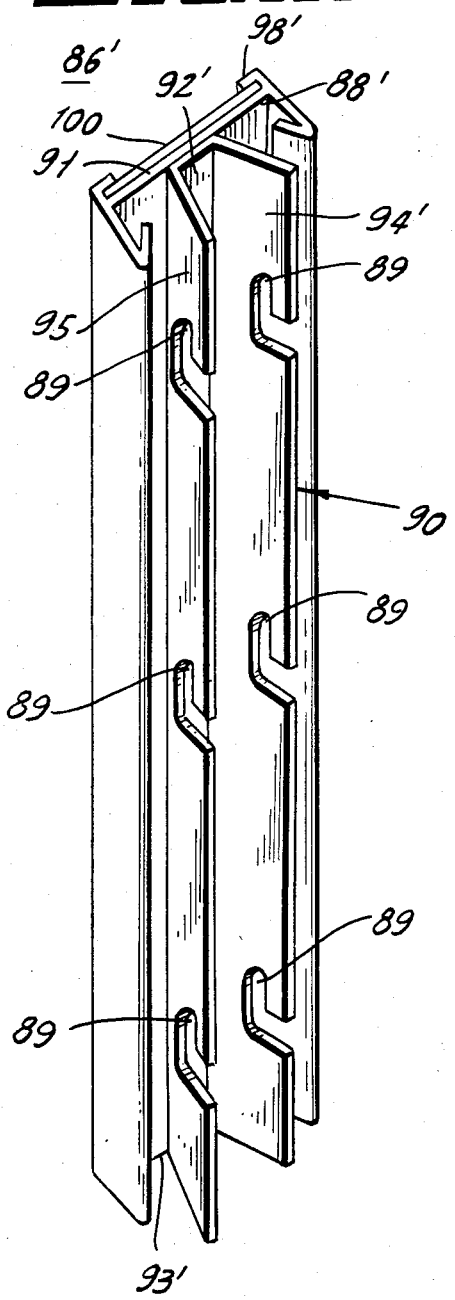
FIG. 11 is a perspective view showing an alternate embodiment of the end cap.

An alternate embodiment of the end cap is illustrated in FIG. 11. Each of the elements of this embodiment which corresponds to those of FIG. 8 have been designated by the same number with a prime added thereto. The primary difference between the embodiment of FIG. 8 and FIG. 11 resides in the structure of bracket 90'. In the embodiment of FIG. 11, the bracket 90' includes a flat section 92' and oblique sections 94' and 95. Sections 94' and 95 are disposed at equal but opposite angles with respect to flat section 92 so as to enable the end cap 86 to be used in connection with the left-hand divider 68, the right-hand divider 70 and the center divider 72 without the need for rotating the end cap 86' about the axis 110 of FIG. 8.

In this embodiment, a plurality of L-shaped slots are formed in the oblique sections 94' and 95. These slots are designed to receive the shafts of threaded bolts which are permanently coupled to the hinge 60 of the respective dividers. If desired, a similar arrangement can be used with respect to the end cap 86 of FIG. 8.

The fully assembled display unit may be optionally positioned to rest on a floor without further provisions. An optional gondola or platform 102 may be interposed between the floor and the base 22 of the display unit. The gondola or platform 102 may be useful for providing a foundation for the display unit and it may be particulary useful to overcome and compensate for uneven or damaged floor bases. The gondolar may further protect the base of the display unit, which is not generally designed as a weight bearing structure from accidental damage which may result from misuse of the display unit.

Although the present invention has been described in connection with preferred embodiments, many variations and modifications will now be apparent to those skilled in the art. It is preferred, therefore, that the present invention be limited not by the specific disclosure herein, but only by the appended claims.

What is claimed is:

1. A kit for forming a variable sized bay-shaped display, comprising:

(a) a plurality of planar rear wall sections;

(b) means for coupling said rear wall sections together to form a continuous rear wall;

(c) a plurality of bay dividers, each of said bay dividers including a pair of generally planar side panels which are hingedly connected to each other, each of said bay dividers including means for orienting, at the option of the user of said kit, said divider with respect to said rear wall in either a right end divider configuration wherein the right panel of the divider forms a right angle with said rear wall and said left panel of the divider forms an oblique angle with said rear wall, a left end divider configuration wherein the left panel of the divider forms a right angle with the rear wall and the right divider forms said oblique angle with said rear wall, or a central divider configuration wherein both said left and right panels form said oblique angle with said rear wall; and (d) a plurality of end caps equal in number to the number of said dividers, each individual end cap having bracket means associated therewith which permit said individual end cap to be coupled to any one of said dividers, at the option of the user of said kit, whether said one of said dividers is arranged in said left end divider, said right end divider or said central divider configuration, said end cap covering the hinge of the divider to which it is attached.

2. The kit of claim 1, wherein each individual end cap is symmetrical about a horizontal axis which lies parallel to said wall when said individual end cap has been coupled to one of said dividers.

3. The kit of claim 2, wherein each of said end caps are identical to each other.

4. The kit of claim 3, wherein each of said bracket means is an angled bracket having a first generally planar section coupled to its said end cap and a second generally planar section extending from said first section at said oblique angle.

5. The kit of claim 4, wherein each said end cap includes a generally planar longitudinally extending section coupled to said first section of said bracket and a pair of side sections located on opposite lateral sides of said longitudinally extending section and perpendicular thereto.

6. A display, comprising:

(a) a generally planar rear wall;

(b) first and second dividers coupled to said rear wall at spaced locations on said rear wall, said first divider forming a triangle with said rear wall and including an angled panel which forms an angle $\alpha$ with said rear wall as measured from an imaginary line running perpendicular to said rear wall, said second divider forming a triangle with said rear wall and including an angled panel which forms an angle $-\alpha$ with said rear wall as measured from said imaginary line; and (c) first and second end caps associated with said first and second dividers, respectively, said first and second end caps including means for coupling each end cap to said angled panel of its associated divider, said end caps being identical to each other.

* * * * *